US006792829B2

(12) United States Patent
Garcia et al.

(10) Patent No.: US 6,792,829 B2
(45) Date of Patent: Sep. 21, 2004

(54) SHINGLE LIFTING TOOL

(76) Inventors: Arturo C. Garcia, 9584 Arbor Glen Dr., Rancho Cucamonga, CA (US) 91730; David Halstead, 5273 Alpine Meadows Ct., Alta Loma, CA (US) 91737

( * ) Notice: Subject to any disclaimer, the term of this patent is extended or adjusted under 35 U.S.C. 154(b) by 8 days.

(21) Appl. No.: 10/014,307

(22) Filed: Oct. 26, 2001

(65) Prior Publication Data

US 2002/0053261 A1 May 9, 2002

Related U.S. Application Data

(60) Provisional application No. 60/243,638, filed on Oct. 27, 2000.

(51) Int. Cl.[7] ..... E04D 15/00

(52) U.S. Cl. ..... 81/45; 30/169; 254/131.5

(58) Field of Search ..... 81/45; 30/169, 30/170; 254/131, 131.5; 299/36.1; 294/49, 57

(56) References Cited

U.S. PATENT DOCUMENTS

| | | | | | |
|---|---|---|---|---|---|
| 1,218,145 | A | | 3/1917 | Whittier | |
| 2,189,480 | A | * | 2/1940 | Tessier | 254/131 |
| 2,714,907 | A | | 8/1955 | Peck | |
| 4,182,390 | A | | 1/1980 | Renner | |
| 4,466,188 | A | * | 8/1984 | Svendsgaard | 254/131.5 |
| 4,809,436 | A | * | 3/1989 | Crookston | 254/131.5 |
| 5,010,791 | A | | 4/1991 | Williams | |
| 5,159,859 | A | | 11/1992 | Whiteshell | |
| 5,280,676 | A | | 1/1994 | Fieni | |
| 5,690,374 | A | * | 11/1997 | Jacobs et al. | 294/57 |
| 5,816,634 | A | * | 10/1998 | Jacobs et al. | 294/57 |
| 5,906,145 | A | * | 5/1999 | Shepherd | 81/45 |
| 5,957,516 | A | * | 9/1999 | Jacobs et al. | 294/57 |
| 6,128,979 | A | * | 10/2000 | Shepherd | 81/45 |

* cited by examiner

*Primary Examiner*—James G. Smith

(57) ABSTRACT

A lifting tool has a handle, a lifting tool head, and a means for slidably mounting the lifting tool head on the handle such that the lifting tool head slides with respect to the handle between an extended position and a compressed position. The lifting tool further includes a means for biasing the lifting tool head towards the extended position. Since the lifting tool head can slide against the bias of the means for biasing, the lifting tool can absorb some of the shock if the lifting tool head strikes a hard obstruction, thereby sparing a user from the strain and potentially avoiding an injury that could result from the strain.

1 Claim, 5 Drawing Sheets

SHINGLE LIFTING TOOL

CROSS-REFERENCE TO RELATED APPLICATIONS

This application for a utility patent claims the benefit of U.S. Provisional Application Ser. No. 60/243,638, filed Oct. 27, 2000.

STATEMENT REGARDING FEDERALLY SPONSORED RESEARCH

Not Applicable

BACKGROUND OF THE INVENTION

1. Field of the Invention

This invention relates generally to shingle lifting tools, and more particularly to a shingle lifting tool that includes a shock absorbing system to protect a user from injury.

2. Description of Related Art

Shingle lifting tools are well known in the art. The following art defines the present state of this field:

Whittier, U.S. Pat. No. 1,218,145, teaches a shingle stripper that includes a blade attached to a handle with a socket. The blade is formed of a single square sheet of steel and includes front and rear edges having notches for prying nails.

Peck, U.S. Pat. No. 2,714,907, teaches a shingle lifter that is mounted on a pair of rollers to position an outwardly extending shingle-lifting blade for prying up shingles.

Renner, U.S. Pat. No. 4,182,390, teaches a roof shingle removing tool that includes a main support shaft that is attached to a shingle removing blade. An angled arm extends from the main support shaft so that the user can grip both the main support shaft and the angled arm to utilize the tool for removing shingles.

Williams, U.S. Pat. No. 5,010,791, teaches a shingle pry bar having a triangular prying blade that is secured to a pipe handle at an angle of between 20–25 degrees. The prying blade includes a blunt apex and two lateral sides, each of the sides having notches therein for prying nails and the like.

Whitesell, U.S. Pat. No. 5,159,859, teaches a shingle lifting tool having an articulated, elongated handle having upper and lower sections joined at an intermediate pivot. The lower section is angled forwardly, out of alignment with respect to the upper section. A flat blade is secured to the lower section for slipping beneath shingles. The blade includes a curved arch member to facilitate the lifting and rolling operation of the blade.

Fieni, U.S. Pat. No. 5,280,676, teaches an apparatus for removing shingles and nails from a roof. The apparatus includes a hollow handle portion and a replaceable blade portion attached to the handle. The blade has a front edge having notches for pulling nails. The blade also includes a flat central plate extending rearwardly from the blade.

The prior art teaches various shingle lifting tools. However, the prior art does not teach a shingle lifting tool that includes a shock absorbing system for protecting a worker from stain during the use of the tool. The present invention fulfills these needs and provides further related advantages as described in the following summary.

SUMMARY OF THE INVENTION

The present invention teaches certain benefits in construction and use which give rise to the objectives described below.

The present invention provides a lifting tool having a handle, a lifting tool head, and a means for slidably mounting the lifting tool head on the handle such that the lifting tool head slides with respect to the handle between an extended position and a compressed position. The lifting tool further includes a means for biasing the lifting tool head towards the extended position. Since the lifting tool head can slide against the bias of the means for biasing, the lifting tool can absorb some of the shock if the lifting tool head strikes a hard obstruction, thereby sparing a user from the strain and potentially avoiding an injury that could result from the strain.

A primary objective of the present invention is to provide a lifting tool having advantages not taught by the prior art.

Another objective is to provide a lifting tool having a shock absorbing system that reduced stress and strain on the arms of the user.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
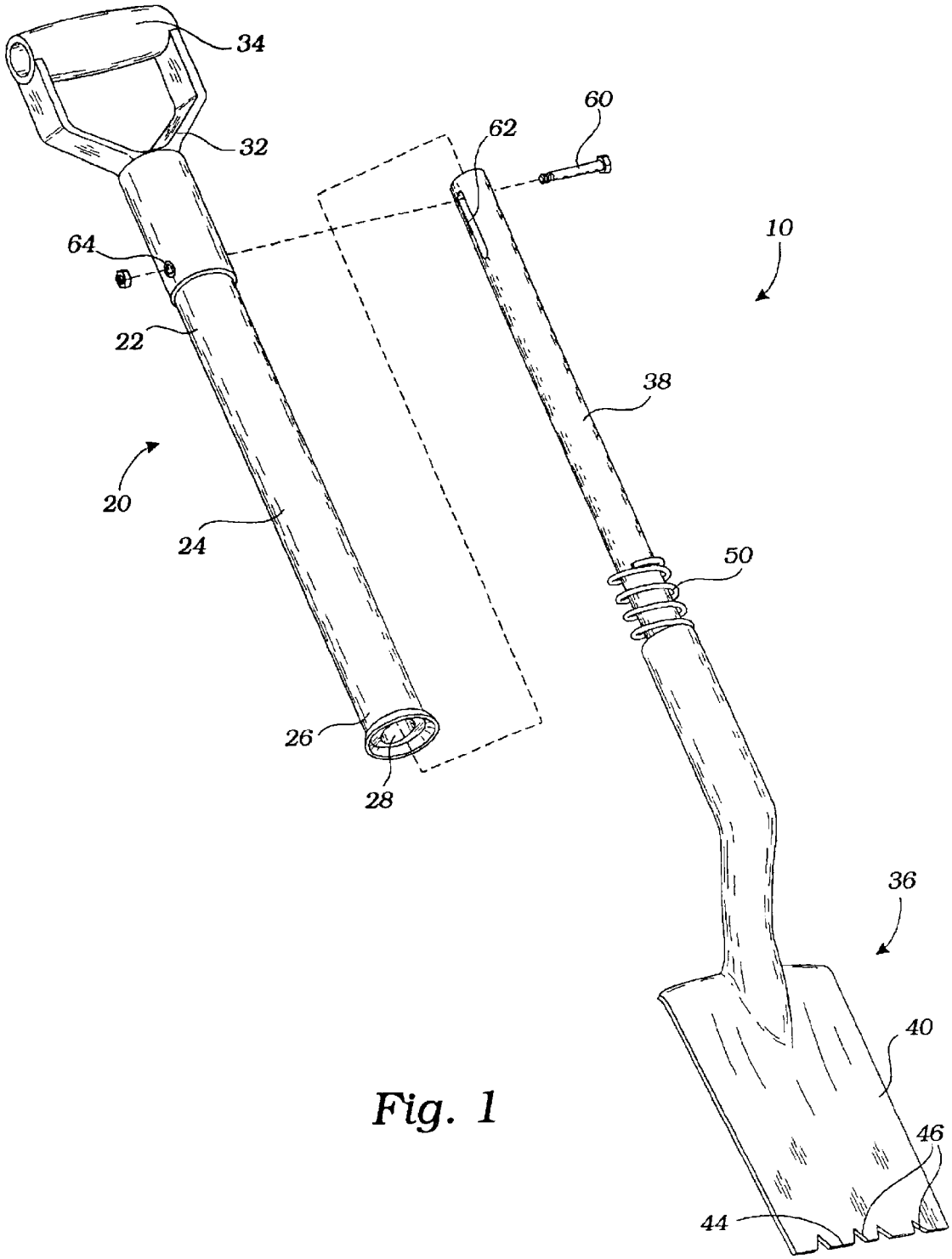
FIG. 1 is an exploded perspective view of a first embodiment of the present invention, a shingle lifting tool for removing shingles from a roof.

The above-described drawing figures illustrate the invention, a lifting tool 10 having a handle 20, a lifting tool head 36, and a means for slidably mounting the lifting tool head 36 on the handle 20 such that the lifting tool heads 36 slides with respect to the handle 20 between an extended position and a compressed position. The lifting tool 10 further includes a means for biasing 50 the lifting tool head 36 towards the extended position. Since the lifting tool head 36 can slide against the bias of the means for biasing 50, the lifting tool 10 can absorb some of the shock if the lifting tool head 36 strikes a hard obstruction such as a nail 12, thereby sparing a user from the strain and potentially avoiding an injury that could result from the strain.

In one embodiment, as shown in FIGS. 1–3 and 5, the lifting tool 10 is a shingle lifting tool 10. In this embodiment, the lifting tool head 36 is provided by a shingle lifting head 36 that is adapted for lifting shingles from a roof The shingle lifting head 36 includes a planar face 40 having a leading edge 44 that is preferably straight and adapted to slide under the shingles and thereby facilitate their removal. He leading edge 44 preferably includes at least one notch 46 shaped to fit around the nail 12 for removing the nail 12. The planar face 40 preferably includes a pry bar lever 42 that extends downwardly from the planar face 40 and is shaped to provide superior leverage for using the leading edge 44 to pry up the shingles.

Figure 4:
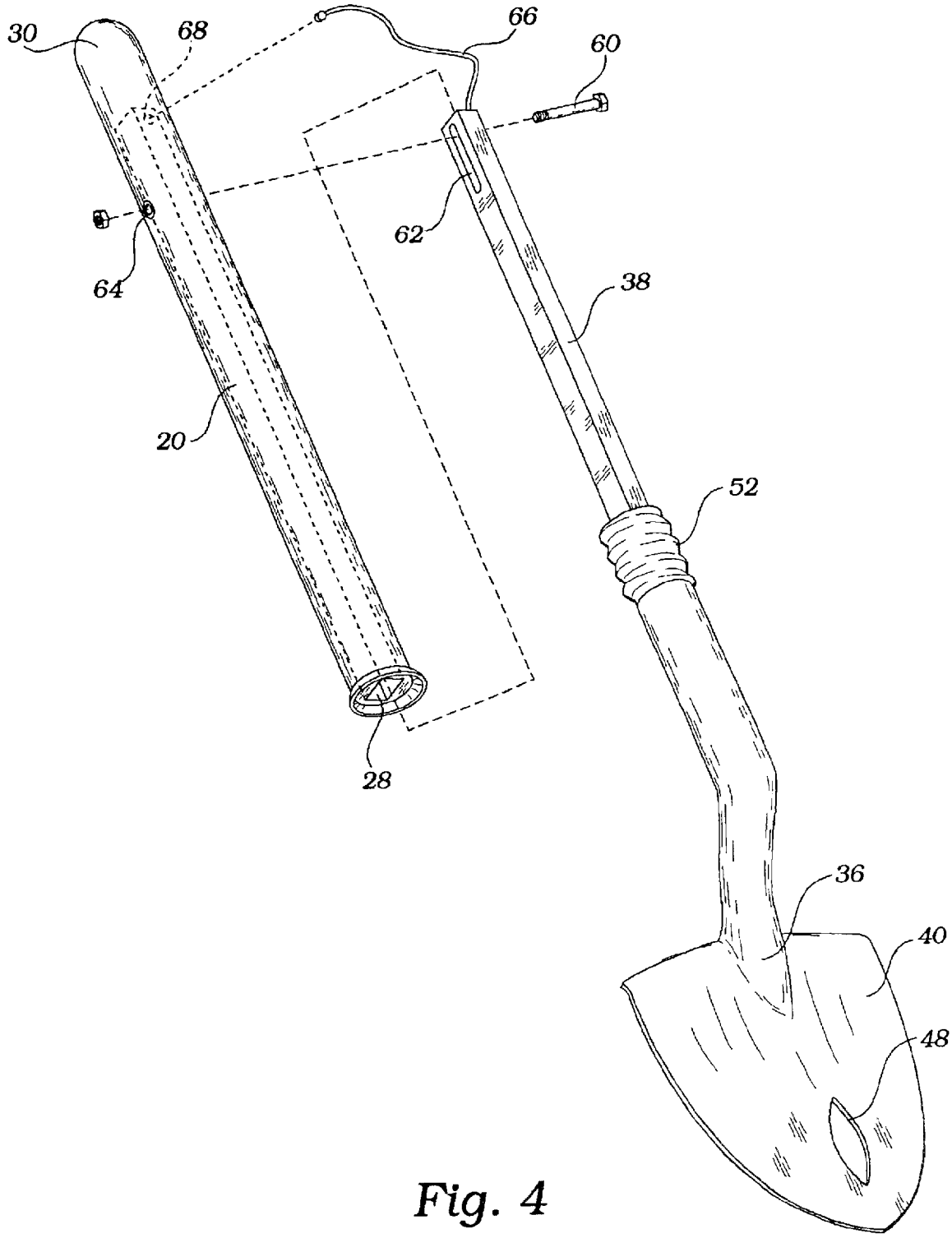
FIG. 4 is an exploded perspective view of an alternative embodiment of a lifting tool.

In an alternative embodiment, as shown in FIG. 4, the planar face 40 includes an elongate aperture 48 shaped for grabbing the nails 12. The elongate aperture 48 is preferably oval in shape so that the center of the elongate aperture 48 is large enough to receive the nail 12, but the nail 12 cannot escape when it slides to the side of the elongate aperture 48. Obviously those skilled in the art can use apertures having a number of different shapes to provide this function, and these alternative shapes should be considered within the scope of the invention.

Alternative lifting tools 10 do not have to be specifically tailored for use in lifting shingles. Potential alternative designs can include a shovel, as shown in FIG. 4, or other embodiments not shown, such as pry bars, pitch forks, tile prying devices, and the like. Such alternative embodiments are included within the scope of the term lifting tool 10, and should be considered within the scope of the claimed invention.

Figure 2:
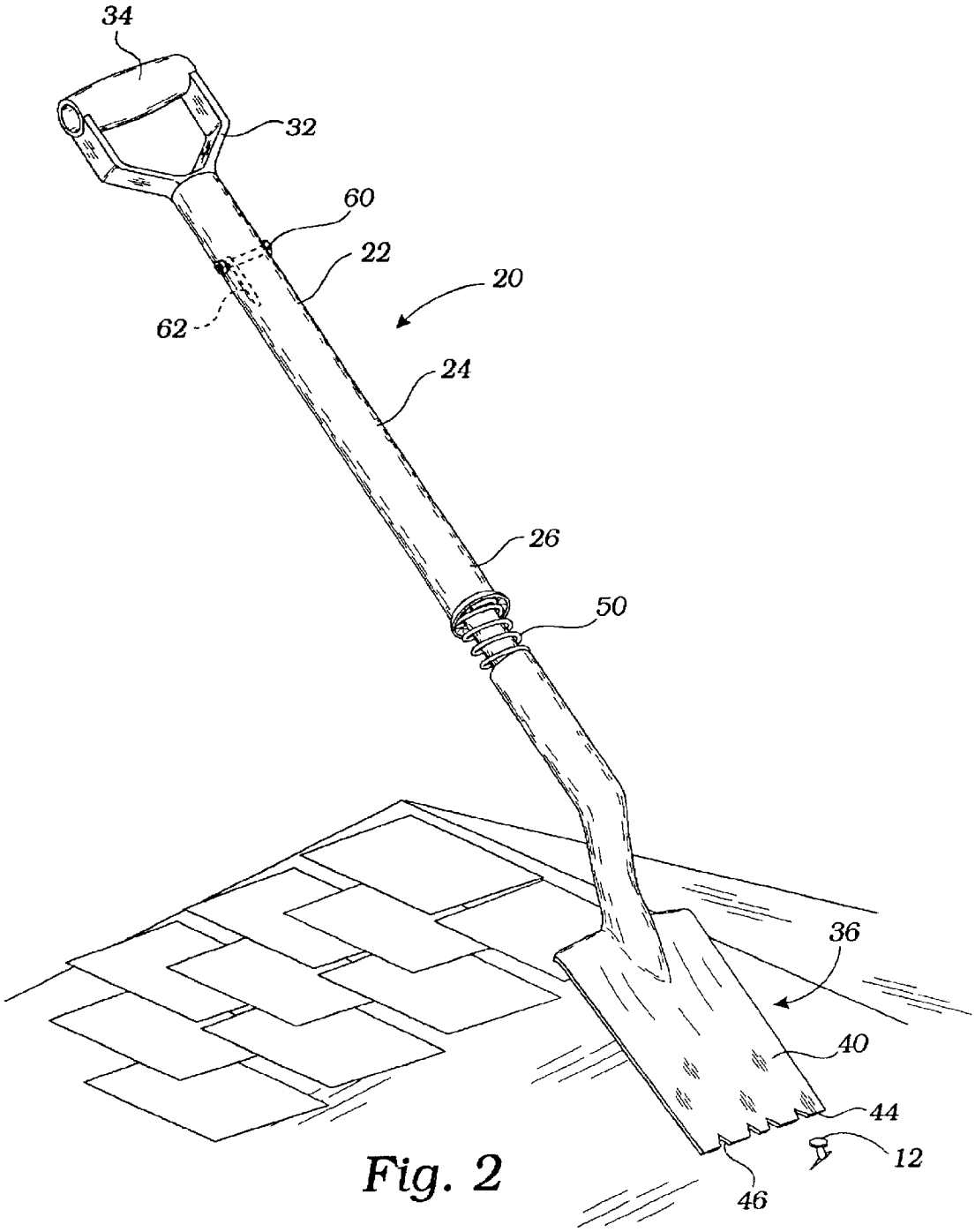
FIG. 2 is a perspective view thereof, illustrating the shingle lifting tool in an extended position.
Figure 3:
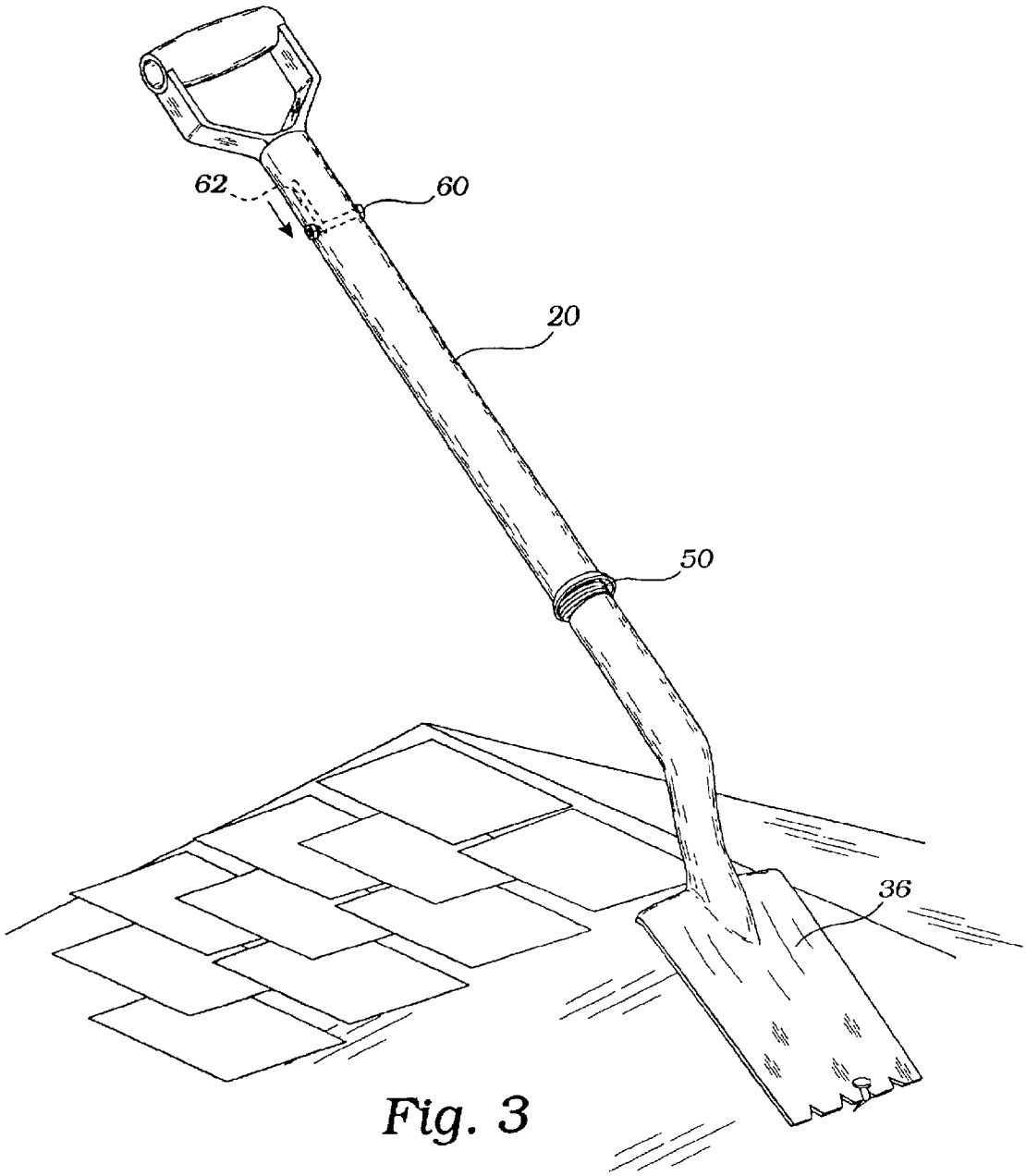
FIG. 3 is another perspective view thereof, illustrating the shingle lifting tool in a compressed position.

As shown in FIGS. 1–5, the handle 20 has a proximal end 22, an elongate body 24, and a distal end 26. The elongate body 24 of the handle 20 is preferably a strong, rigid rod or shaft, constructed of fiberglass, wood, plastic, or similar material, and is adapted to enable a user to grasp the handle 20 for use of the shingle lifting tool 10. In one embodiment, as shown in FIGS. 1–3, the handle 20 further includes a generally U-shaped mounting bracket 32 at the proximal end 22. The generally U-shaped mounting bracket 32 mounts a traverse gripping bar 34 the provides a useful gripping location for the user to utilize the full leverage of the handle 20. While we refer to the generally U-shaped mounting bracket 32 as having a specific shape (generally U-shaped), this terminology is used only because it clearly describes the concept of the element, and this term is considered to encompass alternative shapes that serve the purpose of supporting the traverse gripping bar 34 in its proper traverse position.

Figure 5:
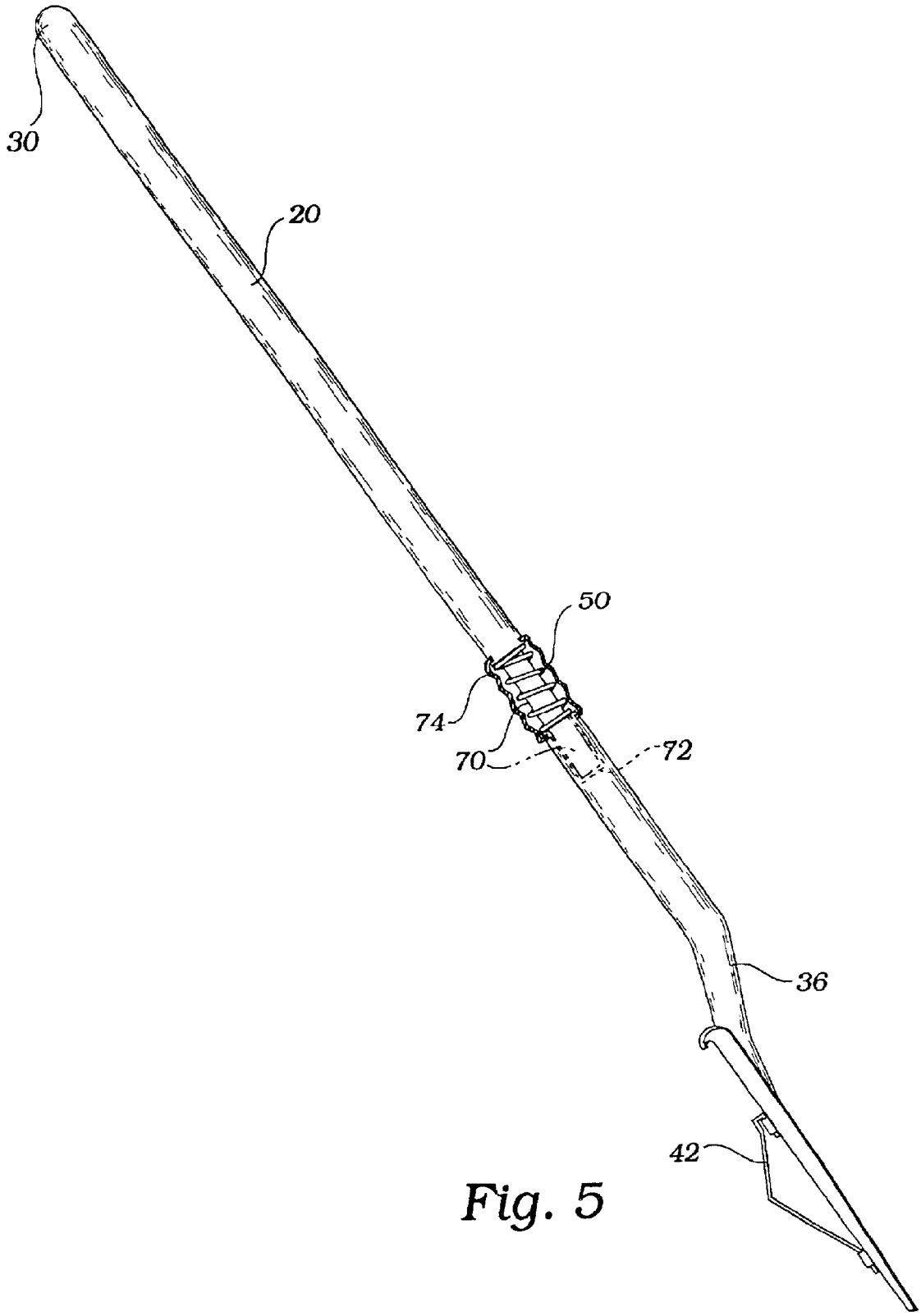
FIG. 5 is a side elevational view of another alternative embodiment of the lifting tool.

In another embodiment, as shown in FIGS. 4–5, the proximal end 22 of the handle 20 has a featureless terminus 30. Since the structure of this type of handle 20 is well known in the art, it is not described in greater detail herein. Those skilled in the art can provide additional features to enhance the function of the lifting tool 10.

The shingle lifting head 36 is attached to the handle 20 with the means for slidably mounting the shingle lifting head 36 on the handle 20. Those skilled in the art can devise many mechanisms for achieving the slidable mount, and any alternative that can be devised by one skilled in the art should be considered within the scope of the invention as claimed. The preferred arrangement is described below.

In one embodiment, as shown in FIGS. 1 and 4, the distal end 26 has an elongate internal cavity 28 extending into the elongate body 24. The elongate internal cavity 28 can have any cross-sectional shape, preferably an asymmetrical shape such as oval, as shown in FIG. 1, or rectangular, as shown in FIG. 4. The shingle lifting head 36 of this embodiment includes a mounting rod 38 extending upwardly from the shingle lifting head 36. The mounting rod 38 is adapted to slidably engage the elongate internal cavity 28 for slidably mounting the shingle lifting head 36 upon the handle 20. The combination of the mounting rod 38 and the elongate internal cavity 28 allows the shingle lifting head 36 to slide with respect to the handle 20 between an extended position and a compressed position.

The shingle lifting tool 10 further includes a means for anchoring the mounting rod 38 within the elongate internal cavity 28 so that the mounting rod 38 does not fall out of the elongate internal cavity 28. In one embodiment, as shown in FIGS. 1–4 the means for anchoring is a mounting bolt 60 adapted to be positioned through a mounting slot 62 of the mounting rod 38 and a mounting aperture of the elongate body 24 to lock the mounting rod 38 within the elongate internal cavity 28.

In an alternative embodiment, as shown in FIG. 5, the means for anchoring is an anchor sleeve 74 that is attached to both the handle 20 and the shingle lifting head 36. The anchor sleeve 74 maintains the shingle lifting head 36 in the extended position and prevents the shingle lifting head 36 from falling off the handle 20. The anchor sleeve 74 can be flexible so that it does not impede the movement of the shingle lifting head 36 with respect to the handle 20; and in another alternative embodiment, the anchor sleeve 74 is slidably fastened to either the shingle lifting head 36 or the handle 20, thereby allowing the necessary movement. Obviously, those skilled in the art can devise similar mechanisms, and such mechanisms should be considered within the scope of the claimed invention.

As illustrated in FIG. 5, it is possible to reverse the means for slidably mounting, and such a reversal is expressly considered within the scope of the claimed invention. While the mounting rod 38 extends from the shingle lifting head 36 in the embodiment shown in FIG. 1, and the elongate internal cavity 28 is within the handle 20, it is possible to reverse these positions. As shown in FIG. 5, the handle 20 includes a downwardly extending rod 70 that mates with a cavity 72 within the shingle lifting head 36.

As shown in FIGS. 1–5, the means for biasing 50 the shingle lifting head 36 towards the extended position is preferably a coil spring; however, any other manner of springs and the like can be adapted by those skilled in the art, and should be considered within the scope of the invention. The coil spring 50 is preferably adapted to fit around the mounting rod 38 and bias the shingle lifting head 36 towards the extended position. As shown in FIG. 2, the coil spring 50 pushes the handle 20 away from the shingle lifting head 36 until the mounting bolt 60 slides to the end of the mounting slot 62. As shown in FIG. 3, when the shingle lifting head 36 strikes a nail 12 or other obstruction, and impact sends a jolt up the shingle lifting head 36, the mounting rod 38 slides into the elongate internal cavity 28 against the bias of the coil spring 50, thereby absorbing the shock.

As shown in FIG. 4, the lifting tool 10 further includes a mounting cable 66 that attaches the shingle lifting head 36 to a cable anchor point 68 of the handle 20. The mounting cable 66 functions as a safety device to prevent the shingle lifting head 36 from falling off of the handle 20. Inadvertently dropping the shingle lifting head 36 from a roof could have deadly consequences to workers below, so added safety features can be important. Equivalent anchors should be considered within the scope of the claimed invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A tool comprising:

a handle;

a tool head;

a means for slidably mounting the tool head on the handle such that the tool head slides with respect to the handle between an extended position and a compressed position;

a means for biasing the tool head towards the extended position; and a mounting cable adapted to attach the tool head to the handle.

* * * * *